US007004813B2

(12) United States Patent
Zuloff

(10) Patent No.: US 7,004,813 B2
(45) Date of Patent: Feb. 28, 2006

(54) TOY GUN WITH GLOWING PROJECTILES AND METHOD OF PROVIDING GLOWING PROJECTILES TO A TOY GUN

(75) Inventor: Steve Zuloff, Chatsworth, CA (US)

(73) Assignee: CYI, Inc., Chatsworth, CA (US)

( * ) Notice: Subject to any disclaimer, the term of this patent is extended or adjusted under 35 U.S.C. 154(b) by 0 days.

(21) Appl. No.: 10/815,344

(22) Filed: Apr. 1, 2004

(65) Prior Publication Data

US 2005/0227580 A1 Oct. 13, 2005

(51) Int. Cl.
*A63H 30/00* (2006.01)

(52) U.S. Cl. ..... 446/175; 446/401; 446/473; 446/475; 446/484; 124/16

(58) Field of Classification Search ..... 446/473, 446/484, 175, 219, 475, 400–404; 473/570; 273/DIG. 27; 124/16, 26, 27, 56, 73, 74, 124/1, 80

See application file for complete search history.

(56) References Cited

U.S. PATENT DOCUMENTS

| | | | | |
|---|---|---|---|---|
| 2,145,277 | A * | 1/1939 | Reardon | 446/182 |
| 4,171,811 | A * | 10/1979 | Meyer et al. | 463/52 |
| 4,175,353 | A * | 11/1979 | Pickett | 446/406 |
| 5,415,151 | A * | 5/1995 | Fusi et al. | 124/56 |
| 6,082,349 | A * | 7/2000 | Cheng et al. | 124/56 |
| 6,648,726 | B1 * | 11/2003 | Hornsby et al. | 446/483 |

* cited by examiner

*Primary Examiner*—Bena Miller
(74) *Attorney, Agent, or Firm*—Howard C. Miskin; Gloria Tsui-Yip

(57) ABSTRACT

A toy gun that shoots glowing projectiles and the method of providing glowing projectiles to a toy gun. The toy gun having a body, at least one black light responsive projectile, a cartridge for supplying the projectiles to the body, at least one black light source within the body for exposing the projectile to black light, a triggering mechanism for engaging the exposed projectile and a launching mechanism for expelling the exposed projectile from the toy gun, such that the projectiles expelled from the toy gun has a glowing effect as if internally lit.

31 Claims, 8 Drawing Sheets

TOY GUN WITH GLOWING PROJECTILES AND METHOD OF PROVIDING GLOWING PROJECTILES TO A TOY GUN

FIELD OF THE INVENTION

The invention relates to an entertainment device for adults and children and specifically, a toy gun that shoots glowing projectiles and the method of providing glowing projectiles to a toy gun. In particular, a toy gun having an internal black light source for sequentially exposing fluorescent or phosphorescent coated projectiles to black light.

BACKGROUND OF THE INVENTION

Ultraviolet (UV) lights encompass lights having wavelengths of 4 to 400 nanometers. The longer wavelengths of the ultraviolet light spectrum are called black light, which have wavelengths slightly shorter than those that are normally visible and is generally safe for human viewing. Black light appears as a deep blue light because only a portion of the light has long enough wavelengths to be visible to human. For the purpose of this invention, blue black lights are simply called black light. An example of a shorter wavelength in the ultraviolet light spectrum is germicidal ultraviolet light that emits a much shorter wavelength that is dangerous to human skin and eyes.

The barely visible and invisible black light energizes objects with black light responsive pigments, such as fluorescent and/or phosphorescent pigments, which then re-emit the light in visible colors. This results in the object appearing to have an independent glow as if internally lit. Once a black light responsive object has been exposed to black light, it retains the glowing effect for a short period of time after the removal of the black light. Black lights have been used as a source of illumination in theatrical productions, amusement park rides and home use for illuminating art covered with fluorescent and/or phosphorescent paint, and for general atmospheric effects for numerous years.

A black light source is generally a tube, similar to a fluorescent tube that produces white light, of a certain length and is not conveniently portable due to the size and the need of either alternating current or large voltage direct current. While black light has been used to illuminate all sorts of fluorescent or phosphorescent objects, black light as a portable device has not been used. Using light emitting diodes (LEDs) that produce UV black lights (generally known as UV LED), black lights can now be incorporated into a hand-held device. The popularity of UV LEDs have increased due to its small size, which is typical of prior art LEDs, and it is powered by direct current such as batteries.

Toy guns are common with children and provide excitement of playing out the hunting and the hunted or shooting targets. Traditional toy gun resembles a real gun and projects fake bullets or pellets at relatively high speed. This type of toy gun is very dangerous to play with as the projectiles can severely injure a child, in particular, his/her eyes, due to the size and speed of the projectiles. Furthermore, ammunition is often lost after shooting from the gun.

In view of the increase in gun violence in today's society, traditional toy guns have been considered politically incorrect and parents minimize their children's exposure to toy guns. Due to the decrease in popularity of toy guns with rigid projectiles, toy guns that project soft or harmless projectiles have increased their popularity in recent years.

Prior art toy guns with soft projectiles include toy water gun, toy air guns and toy guns that uses soft foam disks as ammunitions. A typical prior art toy gun using soft foam disks has a tubular spring-loaded cartridge having an open end and a closed end for storing a plurality of foam disks stacked in a planar fashion. The open end of the cartridge is removably attached to a main body of the toy gun. A spring loaded trigger mechanism in the main body engages one disk at a time from the cartridge and expels it from the toy gun. Some prior art toy guns provide sound and external light effect, such as beeping and with limited lights directed towards the target upon actuating the trigger mechanism, for added entertainment. After all of the disks are discharged from the cartridge, a user needs to collect all the scattered disks and reinsert them into the cartridge. Disadvantageously, the foam disks discharged from this type of prior art toy guns are often lost due to the size of the disks and are often not recovered. Further, this type of prior art toy guns do not provide for use in a dark environment because the disks cannot be easily recovered.

Therefore, there is a need for a toy gun that facilitates the recovery of its ammunitions, provides for use in a dark environment and provides added entertaining values.

SUMMARY OF THE INVENTION

The present invention provides a toy gun having an internal black light source for exposing black light responsive ammunitions to black light.

The toy gun of the present invention comprises a body, at least one black light responsive projectile, means for supplying the projectile to the body, at least one black light source positioned within the body for exposing for a short period of time the projectile to black light, a triggering mechanism for selectively engaging the treated projectile and a launching mechanism for expelling this projectile from the toy gun, such that the projectile expelled from the toy gun has a glowing effect as if internally lit.

In the preferred embodiment, the black light responsive projectiles are soft foam disks coated with fluorescent or phosphorescent pigments and means for staging is provided to expose each projectile to the black light source prior to being expelled from the toy gun.

The method of providing glowing projectiles for a toy gun, comprising the steps of providing at least one black light responsive projectile, providing means for supplying and storing said projectile within said toy gun, providing at least one black light source within said toy gun, providing a staging area for said projectile, providing a triggering mechanism for engaging said projectile from said supplying and storing means to said staging area, selectively exposing said at least one black light responsive projectile to said at least one black light source at said staging area, and providing a launching mechanism for engaging said projectile at said staging area and expelling said treated projectile from said toy gun.

The toy gun with glowing projectiles allows a user to use the toy gun in the dark and facilitates easy recovery of all projectiles and provides added entertaining values.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
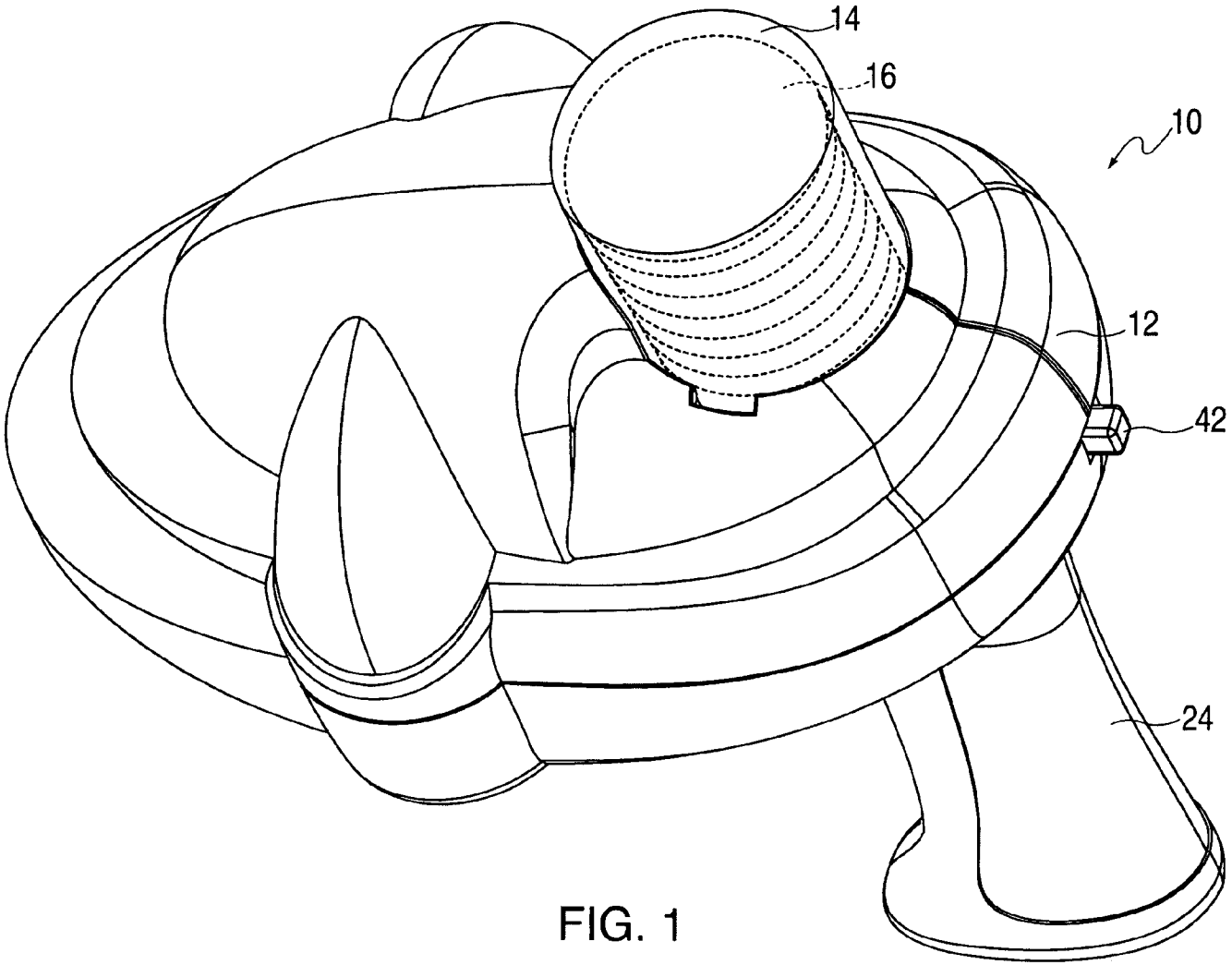
FIG. 1 is a perspective view of the toy gun of the present invention.
Figure 2:
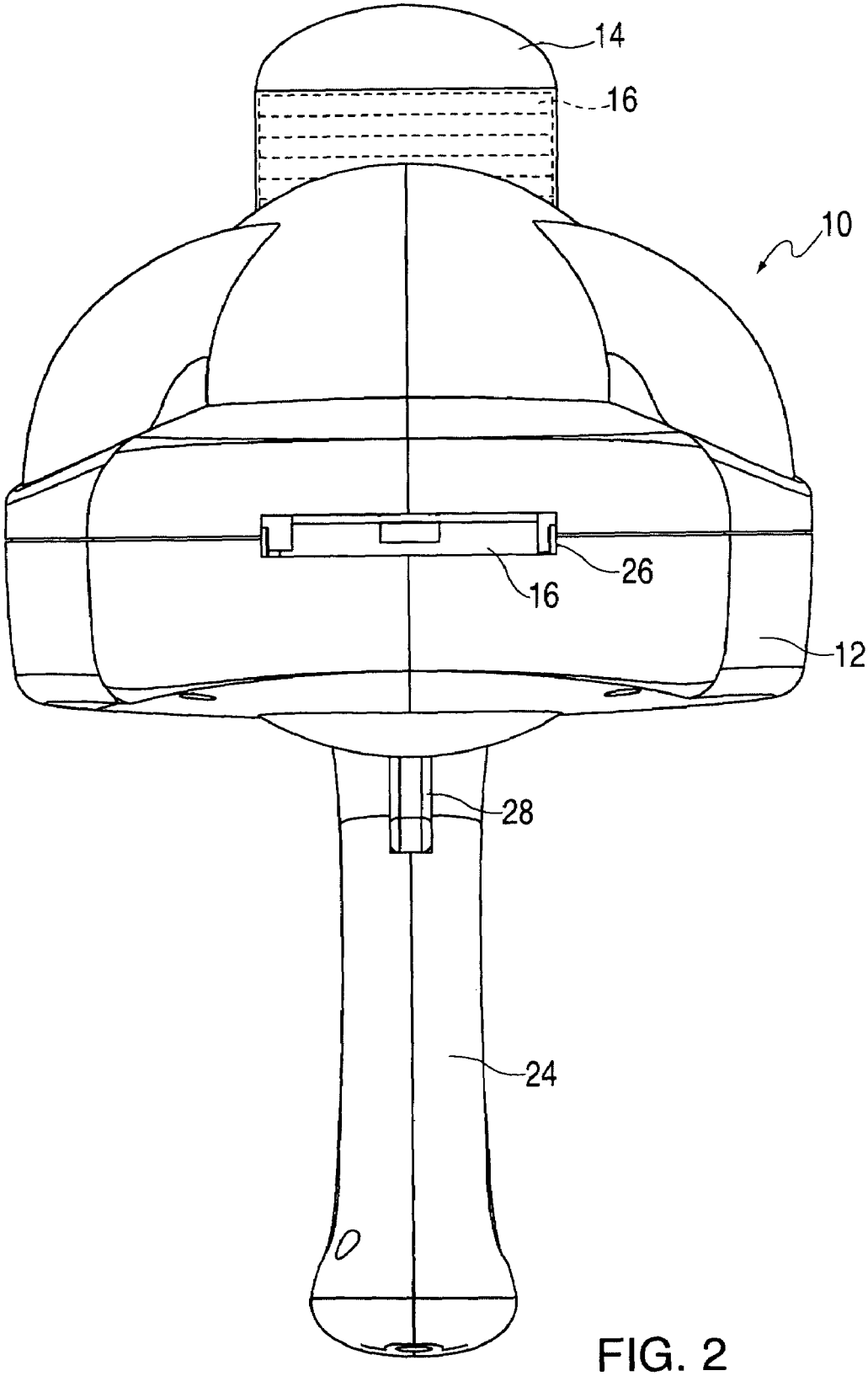
FIG. 2 is a front view thereof.
Figure 3:
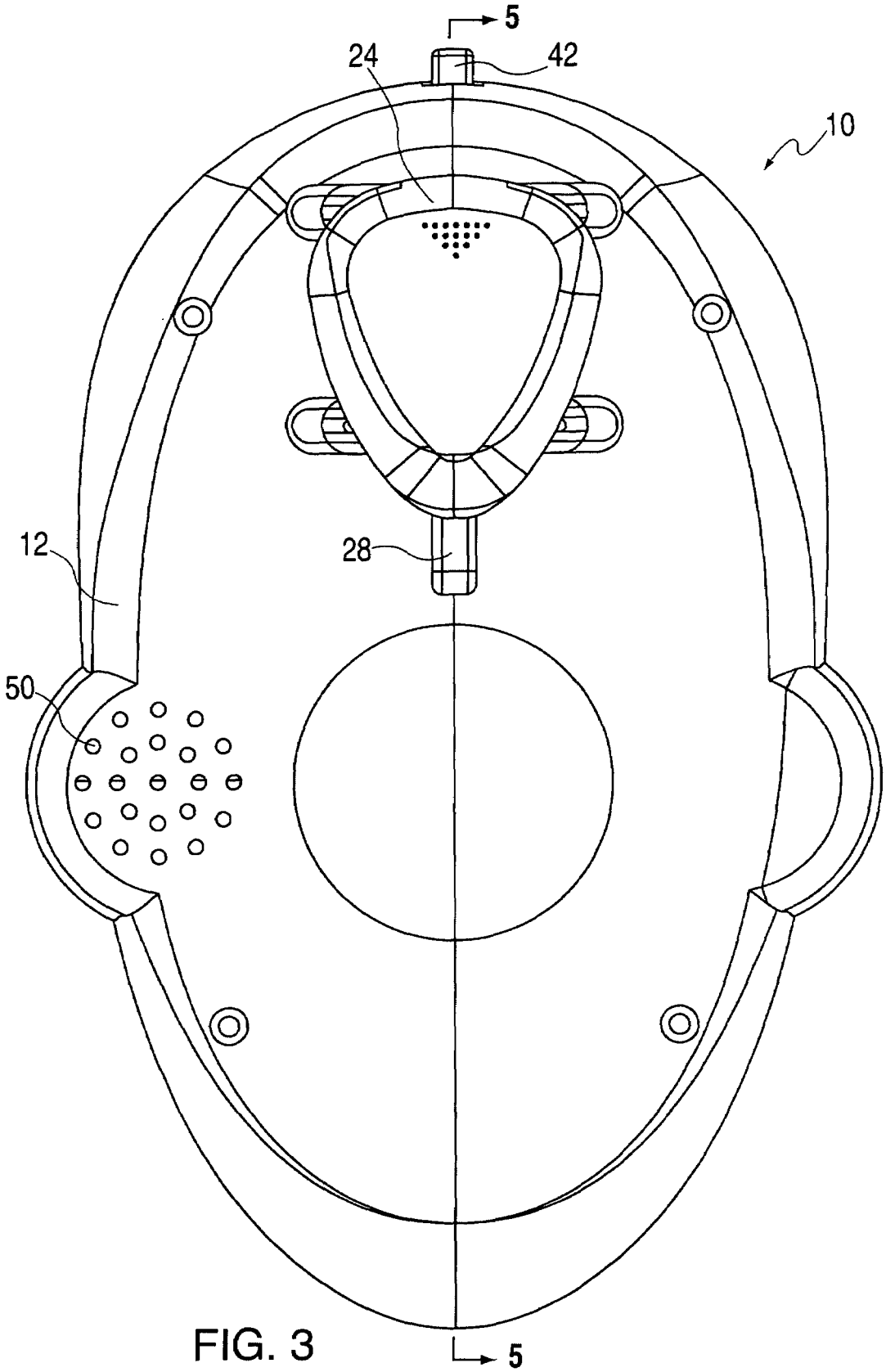
FIG. 3 is a bottom view thereof.
Figure 4:
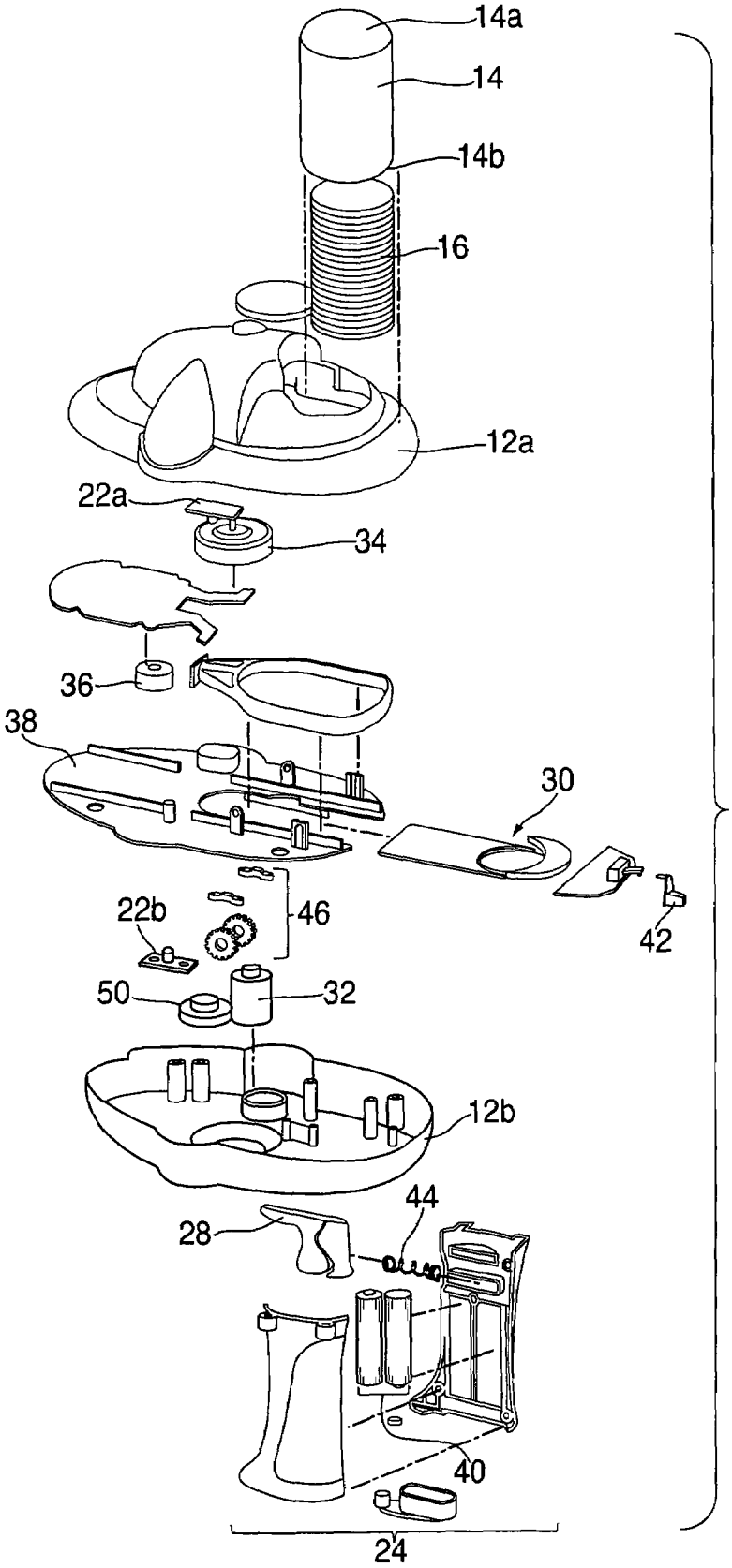
FIG. 4 is an exploded view of the toy gun showing only the major components to simplify this view.

With reference to the drawings, wherein the same reference number indicates the same element throughout, there is shown in FIGS. 1–4 a toy gun 10 of the present invention. As shown in FIGS. 1–4, toy gun 10 comprises a body 12, a cartridge 14 containing a plurality of disk projectiles 16, and a triggering mechanism 18, a launching mechanism 20 and at least one black light source 22 located within the body 12.

The cartridge 14 has a closed end 14*a* and an open end 14*b*, with the open end 14*b* removably attachable to the upper portion of the body 12*a*. A plurality of projectiles 16 is stored in a stacked and planar fashion within the cartridge 14. The open end 14*b* of the cartridge 14 allows the projectiles 16 to engage the triggering mechanism 18 by gravity. Each projectile 16 is black light responsive, such has having fluorescent and/or phosphorescent pigments on the surface. Preferably, the projectile 16 is a disk made of a soft material such as foam. A handle 24 is attached to the lower portion of the body 12*b*. The front of the body 12 has an opening 26 where the projectiles 16 exit the body 12.

The triggering mechanism 18 includes a trigger 28 that actuate an engaging plate 30 that slidably pushes a projectile 16 from the cartridge 14 to a staging area in position to being engaged by the launching mechanism 20.

The launching mechanism 20 includes a driver motor 32, a driver disk 34 connected to the driver motor 32 for engaging the projectile 16 to expel the projectile 16 through opening 26, and an idler disk 36 for pushing the projectile 16 against the driver disk 34 and supporting the projectile 16 to ensure the projectile 16 exits the opening 26 in a reasonably linear fashion as guided by a launching channel 38. The idler disk 36 may be fixed or freely rotatable. The driver motor 32 is powered by a power source such as batteries 40 and is controlled by a power switch 42.

At least one black light source 22 is provided within body 12 to expose the projectiles 16 for a short period of time to black light. A first UV LED 22*a* is provided in the upper portion of the body 12*a* and a second UV LED 22*b* is provided in the lower portion of the body 12*b* to ensure both the upper and lower surfaces of the projectiles 16 are exposed to black light at the staging area prior to being expel by the launching mechanism 20. Generally, having each projectile 16 at the staging area for 500 $\mu$s of exposure to the black light source 22 is sufficient. Each UV LED 22 is also powered by the power source 40 and controlled by power switch 42. More or less UV LEDs may be used for exposing the projectiles 16 to black light.

Figure 5:
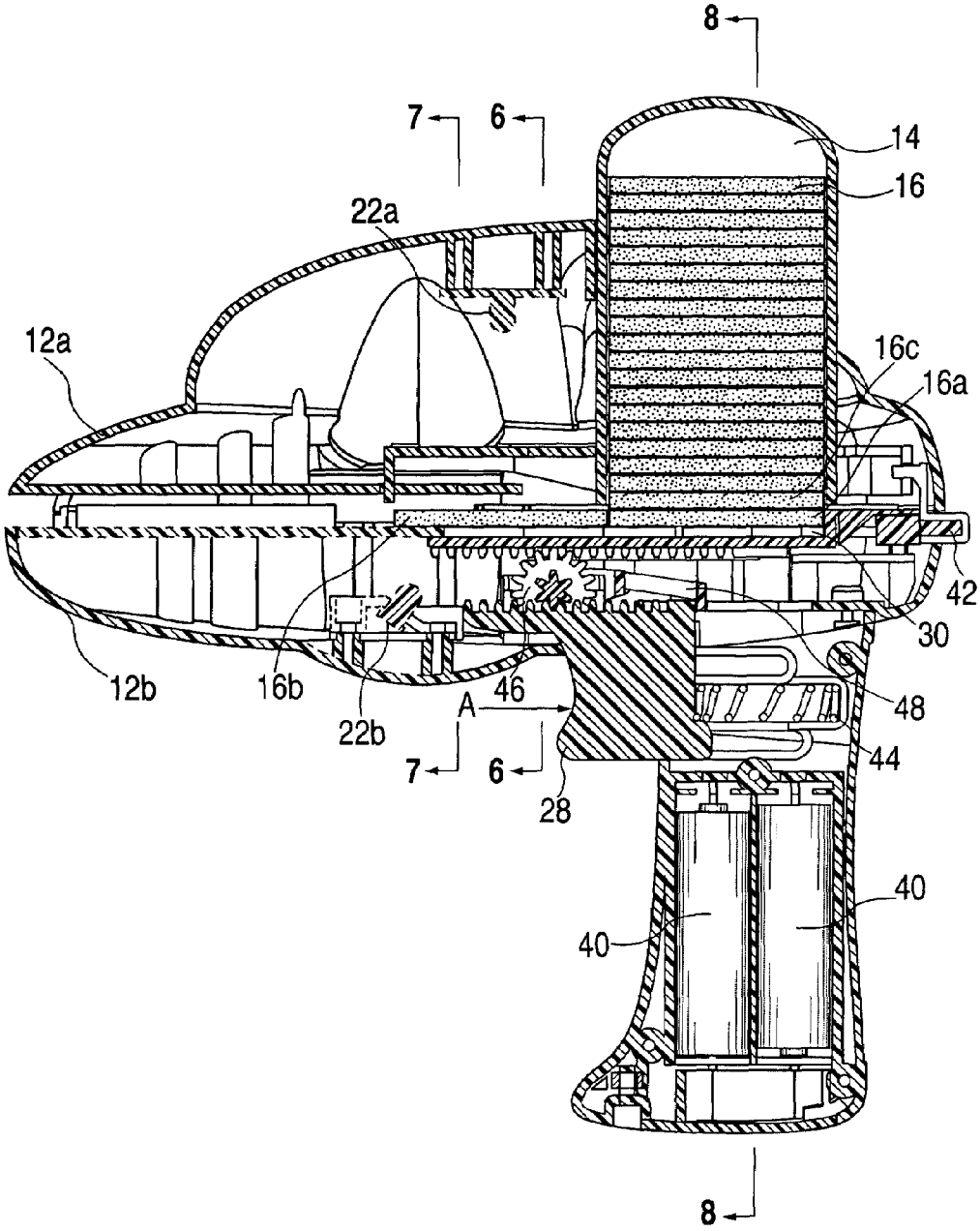
FIG. 5 is a cross sectional view taken across line 5—5 of FIG. 3.
Figure 6:
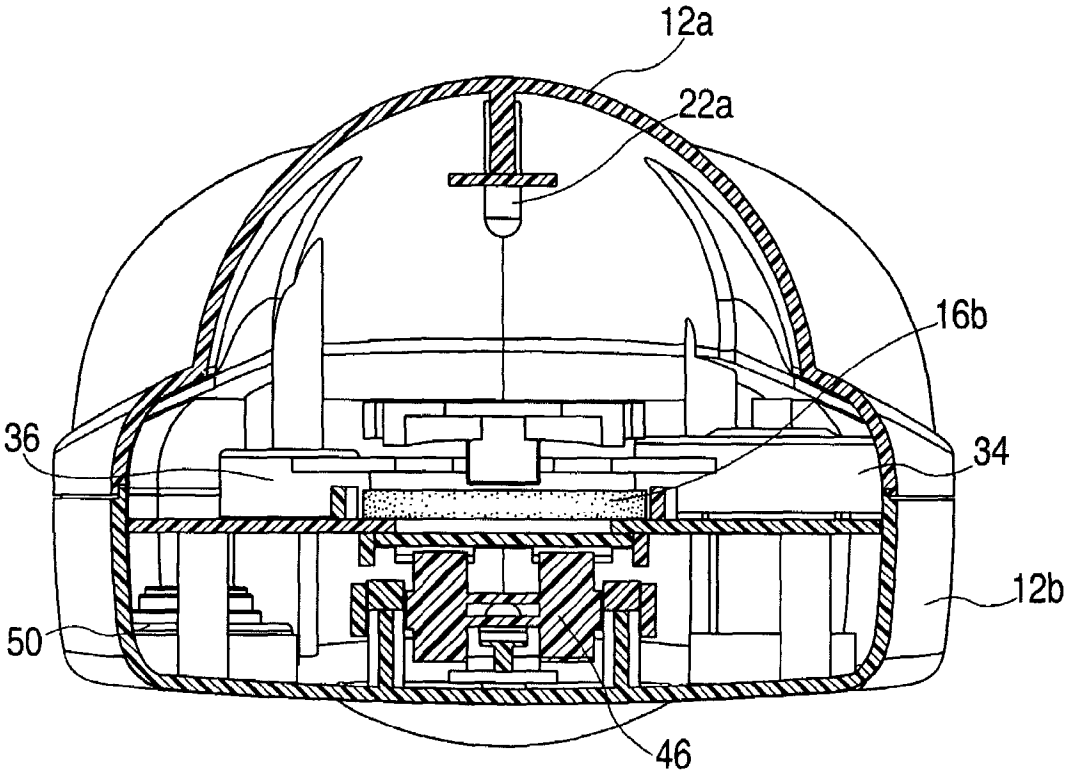
FIG. 6 is a cross sectional view taken across line 6—6 of FIG. 5.
Figure 7:
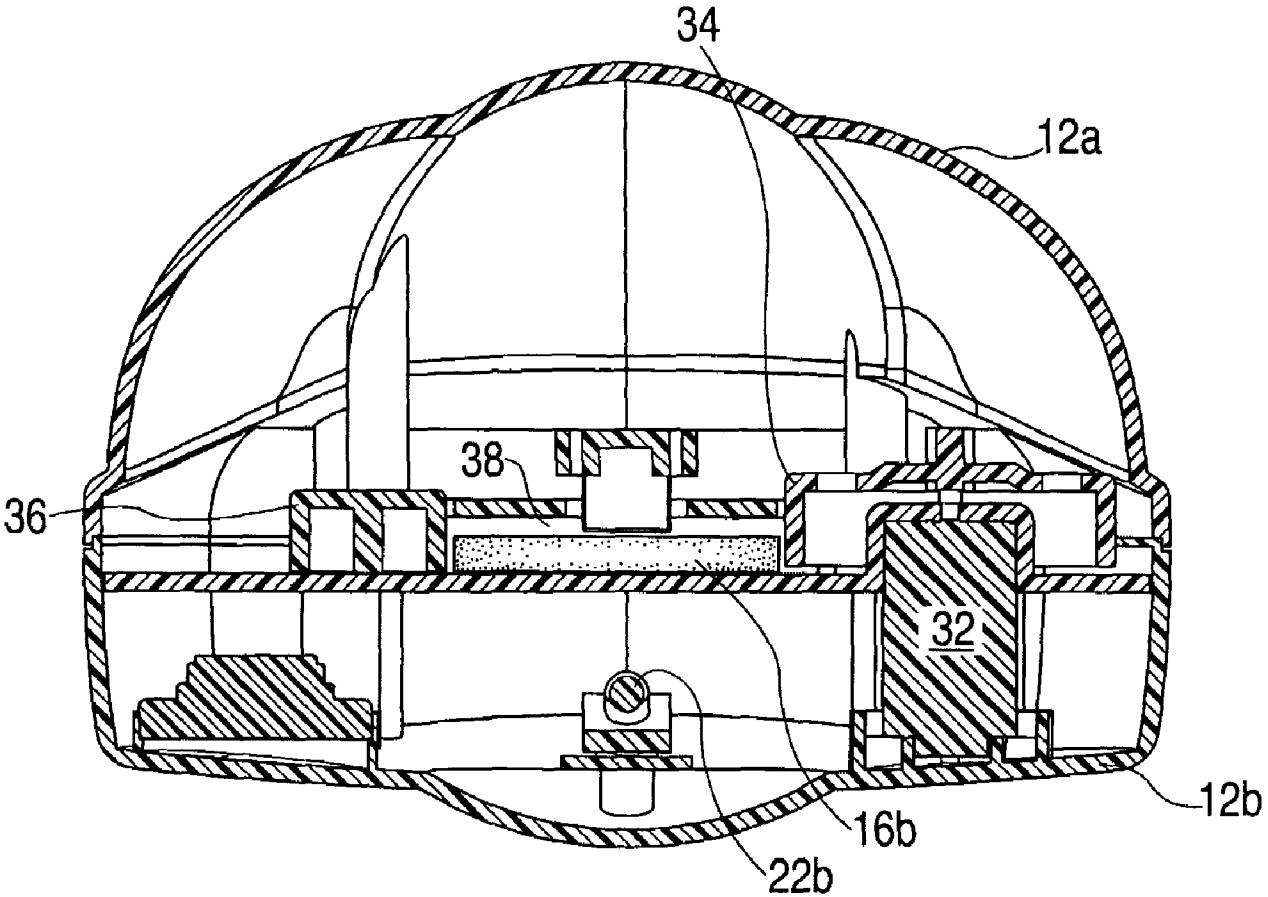
FIG. 7 is a cross sectional view taken across line 7—7 of FIG. 5.
Figure 8:
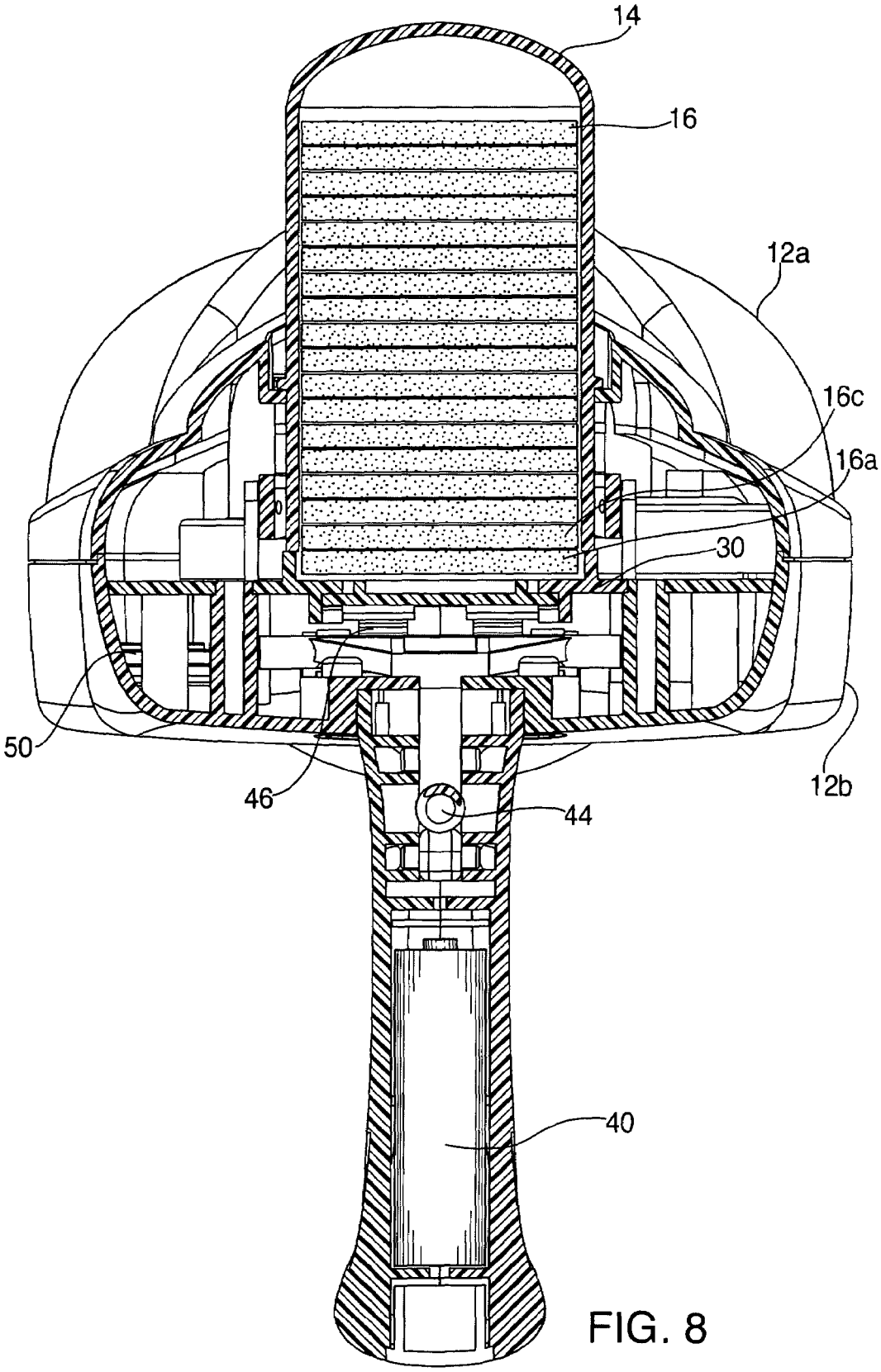
FIG. 8 is a cross sectional view taken across line 8—8 of FIG. 5.

The internal construction and operation of the toy gun 10 is shown with respect to FIGS. 5–8. When the cartridge 14 is filled with one or more projectiles 16 and attached to the upper portion of the body 12*a*, the projectile 16*a* first comes into contact with engaging plate 30. By pulling the trigger 28 in the direction shown by arrow A, spring 44 is compressed and through a gear combination 46, causes the engaging plate 30 to move in the direction opposite arrow A to slidably pushes the projectile 16*a* into the staging area, which is shown to be the position of projectile 16*b*. A latching element 48 known to one skilled in the art is provided to ensure that trigger 28 is moved in the direction shown by arrow A to the maximum position before the trigger 28 can be re-engaged, in order to reset the engaging plate 30 to prevent jamming of the projectiles 16. Once trigger 28 is released, spring 44 causes the engaging plate 30 to return to the original position shown in FIG. 5 and ready to push the next projectile 16 into the staging area.

While each projectile 16*b* is at the staging area, the black light generated by the UV LEDs 22*a* and 22*b* is absorbed by the projectile 16 prior to being expel from the toy gun 10. The UV LEDs 22*a* and 22*b* in the upper and lower portions of the body 12*a* and 12*b*, respectively, ensure that both upper and lower surfaces of each projectile 16 are exposed to black light.

Upon the next actuation of the trigger 28 to allow projectile 16*c* to come in contact with the engaging plate 30, projectile 16*b* will be slidably pushed forward to engage the driver disk 34 and idler disk 36 of the launching mechanism 20. With the power switch 42 actuated, the driver motor 32 imparts a rotational force to the driver disk 34, which along with the idler disk 36, engages the projectile 16 and expels the projectile 16 through launching channel 38 and exits opening 26. The projectiles 16 expelled from the toy gun 10 will glow as if internally lit, which allows a user to use the toy gun 10 in the dark and facilitates easy recovery of all projectiles 16 and provides added entertaining values.

The toy gun 10 may also provide a speaker 50 that produces a sound effect to accompany each actuation of the trigger 28, which is known to one skilled in the art.

The features of the invention illustrated and described herein is the preferred embodiment. Therefore, it is understood that the appended claims are intended to cover the variations disclosed and unforeseeable embodiments with insubstantial differences that are within the spirit of the claims.

What I claim is:

1. A combination toy gun and projectile to be expelled from said toy gun, said toy gun having a triggering mechanism to be actuated by a user, comprising:

a. a body;

b. at least one black light responsive projectile, c. means for supplying and storing said projectile to said body, d. at least one black light source positioned within said body for exposing said projectile to black light, e. a triggering mechanism in said body for selectively engaging said exposed projectile from said supplying and storing means in preparation for expulsion, and f. a launching mechanism within said body for engaging and expelling said exposed projectile from said body;

wherein said triggering mechanism comprises a trigger and an engaging plate, wherein upon actuation of said trigger by a user, said trigger actuates said engaging plate to slidably push each of said projectile sequentially from said supplying and storing means to be in a position for engagement by said launching mechanism; and wherein said projectile expelled from said body has a glowing effect.

2. The combination of claim 1 wherein said body comprises an upper portion and a lower portion.

3. The combination of claim 2 further comprises a handle attached to said lower portion of said body.

4. The combination of claim 2 comprising first and second black light sources, with said first black light source attached to said upper portion of said body and said second black light source attached to said lower portion of said body.

5. The combination of claim 1 wherein said body comprises an opening for expelling said projectile.

6. The combination of claim 1 further comprises a launching channel within said body for expelling said projectile from said body in a reasonably linear fashion.

7. The combination of claim 1 wherein each of said black light responsive projectile is a disk.

8. The combination of claim 1 wherein each of said black light responsive projectile is made of foam.

9. The combination of claim 1 wherein each of said black light responsive projectile contains fluorescent pigment.

10. The combination of claim 1 wherein each of said black light responsive projectile contains phosphorescent pigment.

11. The combination of claim 1 wherein said supplying and storing means is removably attachable to said body.

12. The combination of claim 1 wherein said supplying and storing means comprises a tubular body having an open end and a closed end.

13. The combination of claim 12 wherein said open end of said supplying and storing means is removably attachable to said body.

14. The combination of claim 1 wherein said triggering mechanism further comprises a spring and a gear combination, wherein upon actuation of said trigger by a user, said spring compresses and through said gear combination, actuates said engaging plate.

15. The combination of claim 14 wherein said triggering mechanism further comprises a latching element to ensure that said trigger is fully actuated before said spring returns said engaging plate to its original position.

16. The combination of claim 1 further comprises a speaker within said body that produces a sound effect to accompany each actuation of said triggering mechanism.

17. The combination of claim 1 further comprises a power source supplying energy to said at least one black light source and said launching mechanism.

18. A combination toy gun and projectile to be expelled from said toy gun, said toy gun having a triggering mechanism to be actuated by a user, comprising:

a. a body;

b. at least one black light responsive projectile, c. means for supplying and storing said projectile to said body, d. at least one black light source positioned within said body for exposing said projectile to black light, e. a triggering mechanism in said body for selectively engaging said exposed projectile from said supplying and storing means in preparation for expulsion, and f. a launching mechanism within said body for engaging and expelling said exposed projectile from said body;

wherein said launching mechanism comprises a driver motor that imparts rotational movement, a driver disk connected to said driver motor for engaging and expelling said projectile, and a idler disk for pushing said projectile against said driver disk and for supporting said projectile to ensure said projectile exits said body in a reasonably linear fashion and wherein said projectile expelled from said body has a glowing effect.

19. The method of providing at least one glowing projectile for expulsion from a toy gun, comprising the steps of:

a. providing at least one black light responsive projectile, c. providing means for supplying and storing said projectile within said toy gun, d. providing at least one black light source within said toy gun, e. providing a staging area for said projectile, f. providing a triggering mechanism for engaging said projectile from said supplying and storing means to said staging area, wherein said triggering mechanism comprises a trigger and an engaging plate, g. actuating said trigger by a user, h. said engaging plate slidably pushing each of said projectile sequentially from said supplying and storing means to said staging area, i. exposing said at least one black light responsive projectile to said at least one black light source at said staging area, and j. providing a launching mechanism for engaging said exposed projectile at said staging area and expelling said exposed projectile from said toy gun.

20. The method of claim 19 wherein each of said black light responsive projectile is a disk.

21. The method of claim 19 wherein each of said black light responsive projectile is made of foam.

22. The method of claim 19 wherein each of said black light responsive projectile contains fluorescent pigment.

23. The method of claim 19 wherein each of said black light responsive projectile contains phosphorescent pigment.

24. The method of claim 19 wherein said supplying and storing means is removably attachable to said toy gun.

25. The method of claim 19 wherein said supplying and storing means comprises a tubular body having an open end and a closed end.

26. The method of claim 25 wherein said open end of said supplying and storing means is removably attachable to said toy gun.

27. The method of claim 19 wherein said triggering mechanism further comprises a spring and a gear combination, further comprising the steps of compressing said spring and actuating said engaging plate through said gear combination.

28. The method of claim 27 wherein said triggering mechanism further comprises a latching element, further comprising the steps of fully actuating said trigger with said latching element and returning said engaging plate to its original position by said spring.

29. The method of claim 19 wherein said launching mechanism comprises a driver motor, a driver disk connected to said driver motor and a idler disk, further comprising the steps of imparting rotational movement to said projectile by said driver motor, engaging and expelling said projectile by said driver disk, and pushing said projectile against said driver disk by said idler disk and supporting said projectile by said idler disk to ensure said projectile exits said toy gun in a reasonably linear fashion.

30. The method of claim 19 further comprising the step of providing a sound effect to accompany each actuation of said triggering mechanism.

31. The method of claim 19 further comprising the step of providing a power source to supply energy to said at least one black light source and said launching mechanism.

* * * * *